US008316952B2

(12) United States Patent
Moen

(10) Patent No.: US 8,316,952 B2
(45) Date of Patent: Nov. 27, 2012

(54) SYSTEM AND METHOD FOR CONTROLLING FLOW THROUGH A SAND SCREEN

(75) Inventor: Terje Moen, Sandnes (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 235 days.

(21) Appl. No.: 12/759,432

(22) Filed: Apr. 13, 2010

(65) Prior Publication Data

US 2011/0247813 A1 Oct. 13, 2011

(51) Int. Cl.
*E21B 43/08* (2006.01)

(52) U.S. Cl. ..... 166/373; 166/205

(58) Field of Classification Search ..... 166/205, 166/227, 230, 231, 236, 373, 386
See application file for complete search history.

(56) References Cited

U.S. PATENT DOCUMENTS

| | | | | |
|---|---|---|---|---|
| 5,435,393 | A | 7/1995 | Brekke et al. | |
| 6,745,843 | B2 | 6/2004 | Johnson et al. | |
| 7,469,743 | B2 * | 12/2008 | Richards | 166/242.1 |
| 7,559,375 | B2 * | 7/2009 | Dybevik et al. | 166/316 |
| 7,802,621 | B2 * | 9/2010 | Richards et al. | 166/205 |
| 7,832,473 | B2 * | 11/2010 | Pensgaard | 166/193 |
| 2006/0048942 | A1 | 3/2006 | Moen et al. | |
| 2007/0246407 | A1 * | 10/2007 | Richards et al. | 210/97 |
| 2008/0041582 | A1 * | 2/2008 | Saetre et al. | 166/205 |
| 2008/0169099 | A1 * | 7/2008 | Pensgaard | 166/285 |
| 2008/0217001 | A1 * | 9/2008 | Dybevik et al. | 166/142 |
| 2009/0120641 | A1 | 5/2009 | Yeh et al. | |
| 2009/0133874 | A1 | 5/2009 | Dale et al. | |
| 2010/0122810 | A1 * | 5/2010 | Langlais | 166/230 |

OTHER PUBLICATIONS

International Search Report and Written Opinion dated Nov. 21, 2011 for corresponding PCT Application No. PCT/US2011/031942 filed.

* cited by examiner

*Primary Examiner* — William P Neuder
(74) *Attorney, Agent, or Firm* — David G. Matthews; Rodney Warfford; Robert Van Someren

(57) ABSTRACT

A technique enables an improved filtering of sand, a desired distribution of produced or injected fluid, and a reduction in erosion of completion components positioned in a production or injection well. The technique employs a base pipe and a sand screen surrounding the base pipe. The base pipe comprises a plurality of flow restriction elements arranged in a selected pattern along the base pipe to provide a desired distribution of the fluid flowing into or out of the sand screen. The pattern of flow restriction elements also maintains a flow rate of the flowing fluid below an erosive flow rate across the entire sand screen.

25 Claims, 4 Drawing Sheets

SYSTEM AND METHOD FOR CONTROLLING FLOW THROUGH A SAND SCREEN

BACKGROUND

In many gas wells, inflowing fluid passes through a sand screen which filters out particulates from the inflowing gas. Generally, the flow rate of the inflowing gas is very high such that any sand production can cause substantial erosion of components in a gas well completion. The sand production is controlled with sand screens employed either as stand-alone screens or in combination with a surrounding gravel pack. However, the velocity of the inflowing gas often can exceed an erosion velocity which causes erosion of the sand screen and ultimate failure of the sand screen. Once the sand screen fails, the risk of erosion arises with respect to other elements of the completion. Use of gravel packing may limit the velocity of particulates; however gravel packs are not necessarily uniform along the entire sand screen, resulting in high, erosive flow rates through poorly packed regions.

SUMMARY

In general, the present invention provides a technique for filtering sand; distributing a flow of fluid; e.g. distributing an inflow of gas or condensate; and limiting the potential for erosion of completion components in a wellbore. By way of example, the technique is useful in production applications, but the technique also can be used in fluid injection applications, e.g. gas injection applications. The technique employs a base pipe and a sand screen surrounding the base pipe. The base pipe comprises a plurality of flow restriction elements deployed in a selected pattern along the base pipe to provide a desired distribution of flowing fluid. The pattern of flow restriction elements also maintains a flow rate of the flowing fluid below an erosive flow rate across the entire sand screen.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for filtering sand from flowing fluid, such as from inflowing gas in a gas production well. As explained in greater detail below, the system and methodology also enable a desired distribution of the flowing fluid across the sand screen while keeping the flow rate of the flowing fluid below an erosion flow rate to protect the sand screen from degradation.

According to one embodiment, a well system is provided with one or more sand screen assemblies coupled into a completion and deployed downhole into a gas well. Each sand screen assembly comprises a base pipe surrounded by a sand screen which filters particulates from an inflowing stream of gas during gas production. The base pipe beneath the sand screen is equipped with a plurality of flow restriction elements through which the inflowing gas moves to an interior of the base pipe after passing through the sand screen.

The flow restriction elements are sized and distributed to provide a controlled pressure drop and to eliminate regions of high flow velocity along the sand screen. The flow velocity is restricted to a rate below an erosion rate of the sand screen to prevent degradation and failure of the sand screen during gas production. The flow restriction elements may be arranged in a variety of patterns to provide the controlled pressure drop and thus the controlled flow rate through the sand screen. For example, multiple flow restriction elements may be evenly distributed along the base pipe to provide an evenly distributed inflow of gas and a consistent pressure drop along the sand screen. However, other patterns of the flow restriction elements also may be selected to create a desired flow control, e.g. a desired variation in pressure drop and/or flow rate along the sand screen.

Figure 1:
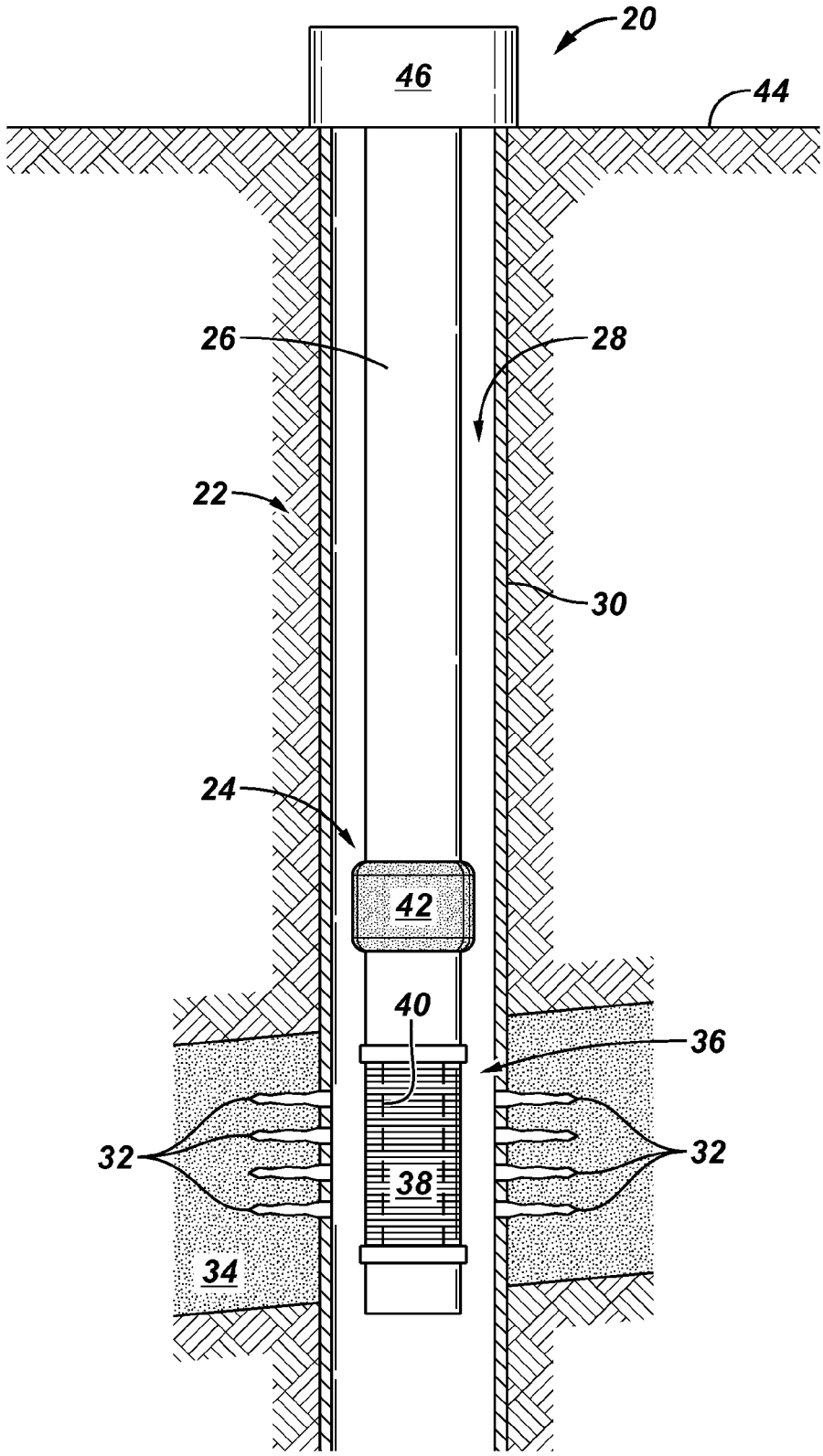
FIG. 1 is a schematic illustration of one example of a sand screen assembly deployed in a well, according to an embodiment of the present invention.

Referring generally to FIG. 1, one schematic example of a well system 20 for use in a well 22 is illustrated. Well 22 may comprise a production well for producing a desired fluid, e.g. gas or oil; or well 22 may comprise an injection well for injecting a desired fluid, e.g. gas or water. The well system 20 is designed to enable filtering of flowing fluid during production (or injection) of fluid from the well 22. In this particular example, well system 20 may comprise a well completion 24, e.g. a gas production well completion, deployed downhole into a wellbore of well 22. The completion 24 may be deployed downhole via a conveyance 26, such as coiled tubing, production tubing, or another suitable conveyance. Depending on the specific application, well 22 may comprise a wellbore 28 which is cased or lined with a casing 30 having perforations 32 to enable fluid communication between a surrounding reservoir/formation 34 and the wellbore 28.

However, completion 24 may be employed in open wellbores or in a variety of other wellbores, environments and wellbore configurations designed to maximize retrieval of the desired hydrocarbon based fluid, e.g. gas. The completion 24 also may be designed for fluid, e.g. gas, injection applications.

Well completion 24 potentially includes many types of devices, components and systems. For example, the well equipment may comprise a variety of artificial lift systems, sensor systems, monitoring systems, and other components designed to facilitate production operations, servicing operations, and/or other well related operations. In the example illustrated, well completion 24 further comprises a sand screen assembly 36.

The sand screen assembly 36 has a sand screen 38 designed to filter sand from gas or other fluid flowing across the sand screen 38. During gas production, for example, gas flows into wellbore 28 from formation 34 and passes through sand screen 38 which filters out sand while allowing the remaining gas to pass into completion 24. The sand screen 38 may be used in cooperation with and/or be positioned between other components of the well completion 24. Additionally, the sand screen assembly 36 may comprise a base pipe 40 positioned such that the sand screen 38 is mounted to surround the base pipe 40.

Completion 24 also may comprise one or more isolation devices 42, e.g. packers, positioned to enable selective isolation of a specific well zone associated with the sand screen assembly 36. It should be noted that well completion 24 may further comprise additional sand control assemblies 36 and isolation devices 42 to isolate and control fluid flow, e.g. gas flow, from (or to) other well zones of the reservoir/formation 34.

In FIG. 1, wellbore 28 is illustrated as a generally vertical wellbore extending downwardly from a surface location 44. Additionally, completion 24 is illustrated as deployed downhole into the generally vertical wellbore 28 beneath surface equipment 46, such as a wellhead. However, the design of wellbore 28, surface equipment 46, and other components of well system 20 can be adapted to a variety of environments. For example, wellbore 28 may comprise a deviated, e.g. horizontal, wellbore or a multilateral wellbore extending from surface or subsea locations. The well completion equipment 24 also may be designed for deployment into a variety of vertical and deviated wellbores drilled in a variety of environments.

Figure 2:
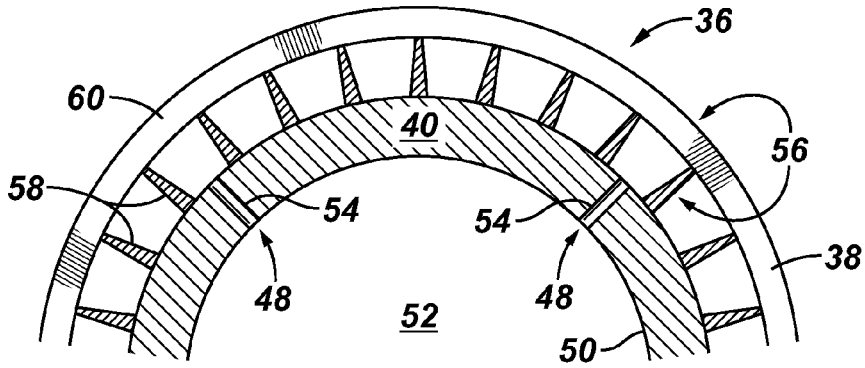
FIG. 2 is a partial cross-sectional view of the sand screen assembly taken generally across an axis of the sand screen assembly, according to an embodiment of the present invention.

Referring generally to FIG. 2, one embodiment of sand screen assembly 36 is illustrated. In this embodiment, base pipe 40 comprises a plurality of flow restriction elements 48, and sand screen 38 is mounted around base pipe 40 and the plurality of flow restriction elements 48. The flow restriction elements 48 are designed to allow gas flow through a sidewall 50 of base pipe 40 and into an interior 52 of the base pipe for production to a desired location. The plurality of flow restriction elements 40 are arranged in a desired, predetermined pattern to provide a controlled pressure drop across the base pipe 40, and thereby to provide a controlled flow rate of inflowing gas through sand screen 38. The flow restriction elements 48 also may be employed for use with other fluid, e.g. condensates, oil or water, flowing at a high flow rate into or out of the base pipe 40 during production or injection applications.

Various sizes, densities and patterns of flow restriction elements 48 may be located along the base pipe 40 which is positioned radially beneath the surrounding sand screen 38. The sizes, densities and patterns of flow restriction elements 48 are selected according to the environment, downhole pressures, quality of the formation, presence of a surrounding gravel pack, and other environmental parameters. The size, density and arrangement of the flow restriction elements 48 establish the desired pressure drop along the base pipe 40 and also serve to sufficiently reduce the flow velocity of the gas or other fluid below an erosion flow rate. In specific applications, the arrangement of flow restriction elements 48 is selected to reduce the flow rate of inflowing gas (and particulates carried with the inflowing gas) to a rate which does not cause erosion along any region of the surrounding sand screen 38. In many applications, the flow restriction elements 48 are evenly distributed along the base pipe 40 to provide a constant pressure drop along the base pipe 40 and an evenly distributed inflow of gas. However, the size, density and pattern of the restriction elements 48 also may be varied along the base pipe 40 in a predetermined manner to provide a controlled variation of pressure drop and/or flow rate of, for example, inflowing gas.

Figure 3:
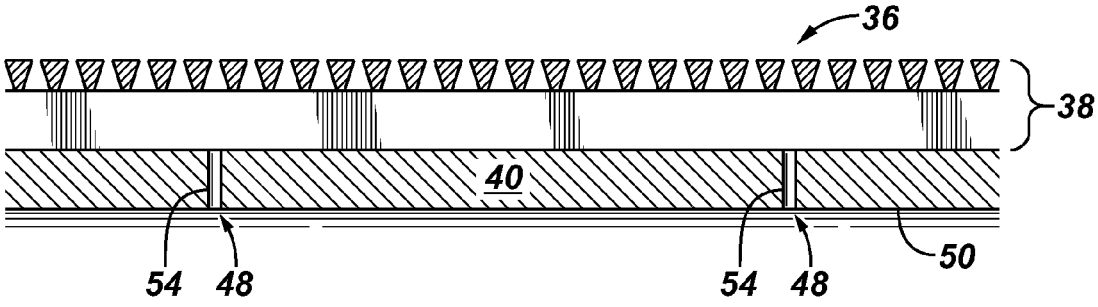
FIG. 3 is a partial cross-sectional view taken generally in an axial direction through a wall of the sand screen assembly, according to an embodiment of the present invention.

In FIGS. 2 and 3, cross-sectional views of portions of one specific embodiment of the sand screen assembly 36 are illustrated. In this embodiment, the flow restriction elements 48 comprise small holes or orifices 54 extending in a generally radial direction through sidewall 50 of base pipe 40. The orifices 54 have a diameter selected according to the parameters of the downhole application, e.g. gas production application, so as to sufficiently reduce the rate of flowing fluid below an erosion rate of sand screen 38. In many applications, the size of orifices 54 is in the range of one to five times the size of the slot openings/passages through the surrounding sand screen 38. For example, if sand screen 38 is designed with screen openings, e.g. pore or slot openings, approximately 0.25 mm in diameter, the diameter of orifices 54 may be selected in the 0.3 mm to 1.0 mm range. However, formation parameters, e.g. particle size, and other downhole factors may encourage use of smaller or larger orifices 54. The pattern of orifices 54 can be used to significantly reduce flow area through the base pipe 40 and to spread the flowing fluid over a desired perforation pattern. Consequently, the desired pressure drop occurs as fluid moves through sidewall 50 of base pipe 40. The total inflow area created by the sum of flow restriction elements 48 is calculated to give the desired pressure drop and flow rate reduction along the base pipe.

The inflow area provided by flow restriction elements 48 is a function of perforation/orifice diameter and the number of orifices 54. To achieve an even distribution of the flowing fluid, e.g. inflowing gas, as desired in some embodiments, many small holes may be created through sidewall 50 of base pipe 40 in a consistent or even pattern. This type of pattern through the base pipe 40 creates an even gas inflow pattern toward and through the sand screen 38.

In the embodiment illustrated, sand screen 38 comprises a plurality of layers 56 designed to facilitate both filtering and flow through the sand screen 38. Depending on the well environment and other downhole factors, the actual type and number of layers can vary substantially. However, several types of sand screens 38 comprise an internal drainage layer 58 surrounded by a filter media layer 60. Alternate and/or additional layers also may be provided.

Figure 4:
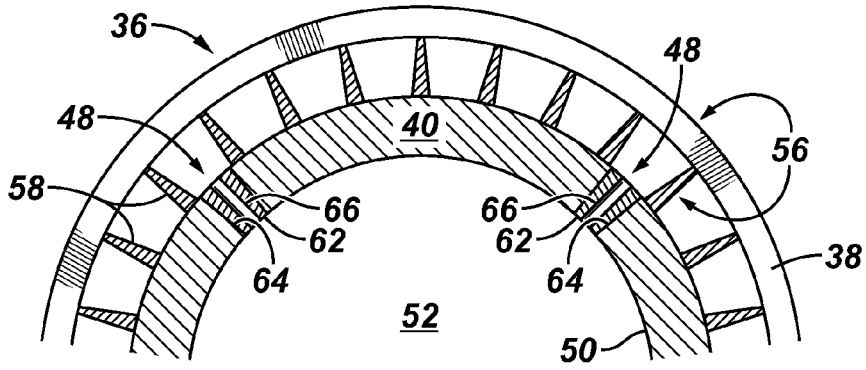
FIG. 4 is a partial cross-sectional view of an alternate example of the sand screen assembly taken generally across an axis of the sand screen assembly, according to another embodiment of the present invention.
Figure 5:
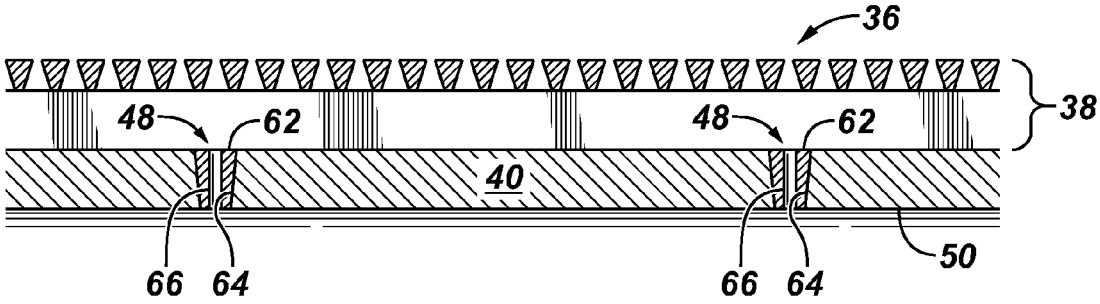
FIG. 5 is a partial cross-sectional view taken generally in an axial direction through a wall of an alternate example of the sand screen assembly, according to another embodiment of the present invention.

In FIGS. 4 and 5, another embodiment of sand screen assembly 36 is illustrated as having sand screen 38 positioned over base pipe 40. In this embodiment, each flow restriction element 48 comprises a nozzle 62 in the form of an insert which is inserted into a corresponding perforation or opening 64 formed radially through sidewall 50. The nozzle inserts 62 may be secured in their corresponding openings 64 by a variety of mechanisms. For example, the nozzle inserts 62 may be threaded into or press fit into corresponding openings 64. The nozzle inserts 62 also may be tapered or conical to facilitate frictional engagement when press fit into corresponding opening 64. It should be noted that in other embodiments, the nozzles 62 may be formed in sidewall 50 without creating separate inserts received in corresponding openings.

In the embodiment illustrated, each nozzle insert 62 comprises a passage 66 through which inflowing gas is routed through sidewall 50 and into the interior 52 of base pipe 40. As described with respect to the previous embodiment, the size of each passage 66 as well as the number and pattern of inserts 62 may be calculated to achieve the desired pressure drop across the base pipe 40 and also the desired reduction in velocity of flowing fluid, e.g. inflowing or outflowing gas, to a flow rate below an erosion rate of the sand screen 38. The nozzle inserts 62 also may be formed from an erosion resistant material, such as a hardened material, carbide material, or other suitable material.

Figure 6:
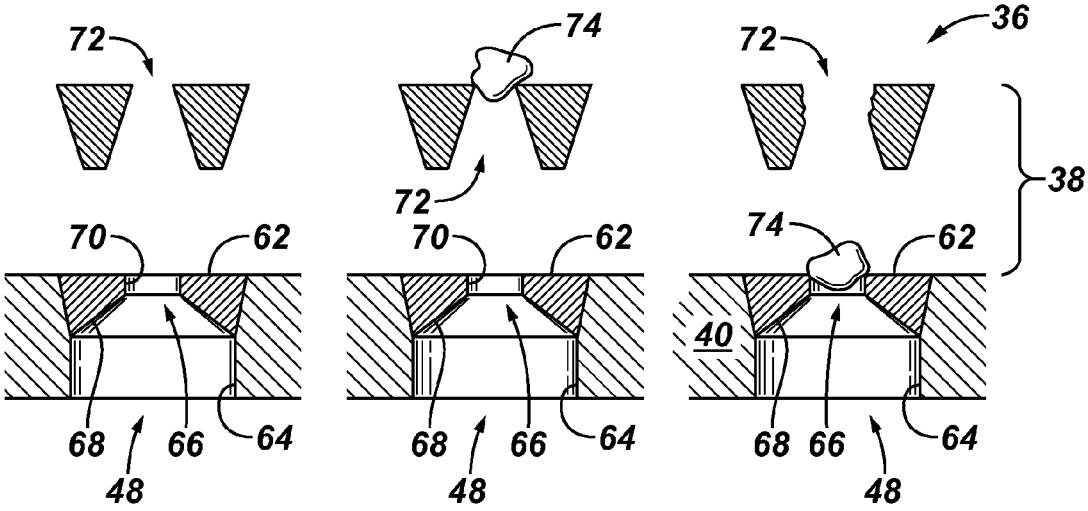
FIG. 6 is a schematic illustration of one embodiment of the flow restriction elements, according to an embodiment of the present invention.

Referring generally to FIG. 6, the nozzles 62 may be designed with flow passages 66 each having an expanded portion 68 downstream of a passage entry opening 70. By way of example, the expanded portion 68 may be designed as a tapered region with a taper having an increasing diameter in the direction of flowing fluid. The expanded portions 68 help prevent plugging of passages 66 if particles pass through screen openings 72, e.g. slots or pores, of sand screen 38. In this design, the entry opening 70 provides the desired flow area, but this region only extends a short length to help prevent plugging.

By choosing nozzles 62 having passages equal to or slightly larger than screen openings 72 of the sand screen 38, a self-healing effect is achieved. If the sand screen 38 undergoes any erosion, as illustrated by the widened screen opening 72 on the right side of FIG. 6, a particle 74 is able to pass through and plug the corresponding nozzle 62. The plugged passage 66 reduces the fluid flow flux in this area and reduces or eliminates any further erosion. Consequently, the diameter/area of passages 66 may be selected based on formation particle size to make sure the particles are able to plug the passage 66 in the event of regional failure of sand screen 38. In some applications, passages 66 may be smaller than screen opening 72 but then the nozzles are subject to unwanted plugging due to fines passing through the sand screen 38.

To further improve this self-healing effect, the drainage layer 58 of the sand screen 38 may be separated into several compartments. The compartmentalization may be achieved by placing inserts or other types of flow blocking members in the axial flow channels of the drainage layer 58 to prevent movement of particles 74 in an axial direction along an exterior of the base pipe 40. Preventing particles 74 from flowing axially or tangentially along an outer surface of the base pipe 40 ensures that a significant portion of the sand screen will not fill with sand even if a small part of the sand screen 38 is eroded. By way of example, the inserts or flow blocking members may comprise a ring in the drainage layer, a segment between structural members, e.g. between axial rods, of the sand screen, a shim placed between wrappings of the screen, or other suitable members designed to compartmentalize the screen and thus prevent any substantial transverse flow of fluid and particulates.

Figure 7:
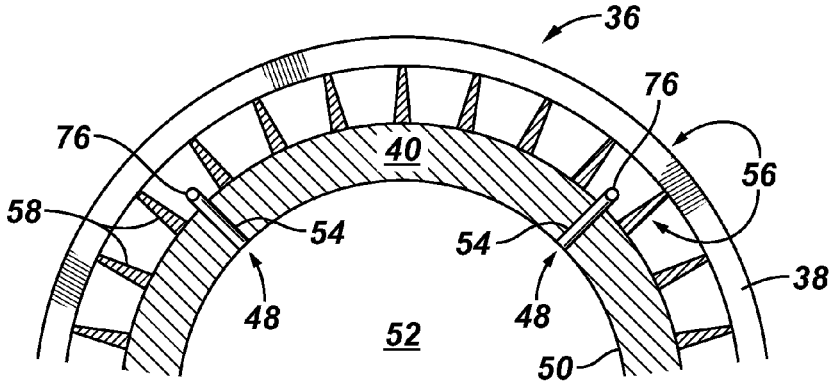
FIG. 7 is a partial cross-sectional view of an alternate example of the sand screen assembly taken generally across an axis of the sand screen assembly, according to another embodiment of the present invention.
Figure 8:
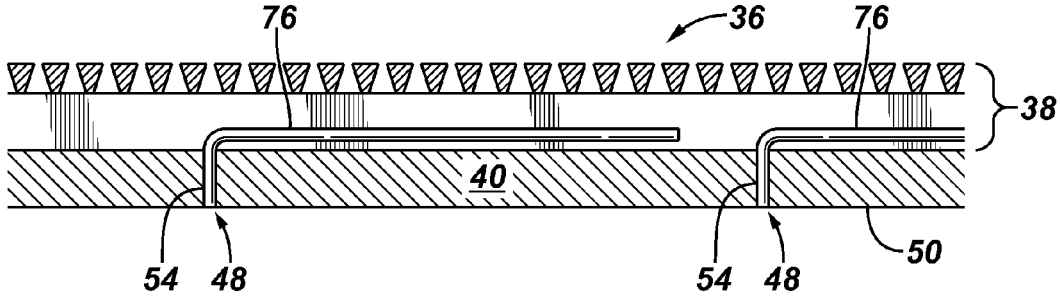
FIG. 8 is a partial cross-sectional view taken generally in an axial direction through a wall of an alternate example of the sand screen assembly, according to another embodiment of the present invention.

Referring generally to FIGS. 7 and 8, another embodiment of sand screen assembly 36 is illustrated as having sand screen 38 positioned around base pipe 40. In this embodiment, each flow restriction element 48 comprises a small tube 76 disposed between an outer surface of the base pipe 40 and the surrounding sand screen 38. In one example, multiple tubes 76 are oriented generally longitudinally between a drainage layer of the sand screen 38 and the outer surface of base pipe 40, as best illustrated in FIG. 8. Additionally, each tube 76 is routed to and coupled with the corresponding hole 54 extending through sidewall 50.

With respect to embodiments of the present erosion prevention system, such as those embodiments discussed above, the size of the passages/flow areas through the flow restriction elements is designed for optimal flow performance. However, various embodiments also may be constructed to provide the self-healing effects discussed above. Generally, each flow restriction element 48 provides a flow connection to the interior 52 of base pipe 40 and acts as a drain for inflowing fluid, e.g. gas, entering the sand screen 38. As a result, the gas flow approaching sand screen assembly 36 tends to converge towards these drainage points.

Figure 9:
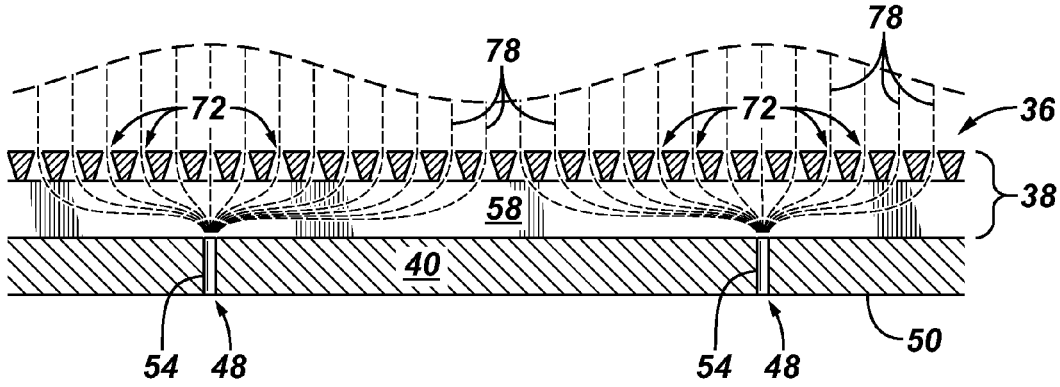
FIG. 9 illustrates one example of a flow profile along a sand screen when fluid inflow is controlled by flow restriction elements, according to an embodiment of the present invention.

The focusing effect of the flow may be controlled, at least somewhat, by the slot/opening density of the sand screen 38 and/or by the cross-sectional configuration of the drainage layer 58, as illustrated schematically in FIG. 9 which provides an example of a flow profile 78 across the sand screen 38. With relatively small areas open to flow through the sidewall 50 of base pipe 40 versus a relatively large cross-sectional area of the drainage layer 58/sand screen 38, a more even flux is achieved with respect to fast flowing fluid, e.g. inflowing gas, approaching the sand screen assembly 36. As the fluid enters the slot opening 72 of the sand screen 38, a small pressure drop occurs. Additionally, a small pressure drop occurs as a fluid flows longitudinally/transversely within the sand screen 38 toward a flow restriction element 48 of base pipe 40. To achieve a small flux variation, the sand screen assembly 36 may be designed so the pressure drop through the screen opening 72 is of a similar order of magnitude as the pressure drop along the drainage layer 58 over the distance between distant flow restriction elements 48.

Desired patterns of flow restriction elements 48 may be selected and designed based on optimization of peak flow velocity versus average flow velocity. Knowledge of the peak flow velocity and the average flow velocity is used to design flow restriction element density and flow area to ensure the velocity approaching sand screen 38 stays below an erosion velocity, thereby reducing or preventing erosion of the sand screen 38.

The overall well system 20 may be constructed to accommodate a variety of flow filtering applications in a variety of well environments while limiting or preventing erosion of the screen and other completion components. Accordingly, the number, type and configuration of components and systems within the overall system may be adjusted to accommodate different applications. For example, the size, number and configuration of the sand screen assemblies may vary from one application to another along the completion equipment. Additionally, many types of flow restriction elements and arrangements of those elements may be employed as dictated by the overall design of gas production equipment and by downhole environmental conditions. The base pipe configuration and the sand screen configuration also may be adjusted according to the specific application and environment. The sand screen assemblies and their erosion control elements may be combined into many types of well completions utilized in production and/or servicing operations. Also, the types and arrangements of other downhole equipment used in conjunction with the one or more sand screen assemblies may be selected according to the specific well related application in which the sand screen assemblies are employed.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of preventing component erosion in a high rate fluid flow well, comprising:

forming a base pipe with a plurality of flow restriction elements extending radially therethrough;

arranging the flow restriction elements to establish a controlled pressure drop across the base pipe;

placing a screen around the base pipe to filter particulates from an inflowing fluid stream; and spacing the plurality of flow restriction elements along the base pipe to create a distributed inflow of fluid which maintains a flow rate of the inflowing fluid below an erosion flow rate across the entire screen.

2. The method as recited in claim 1, wherein forming comprises forming the plurality of flow restriction elements as nozzles positioned in a sidewall of the base pipe.

3. The method as recited in claim 1, wherein forming comprises forming the plurality of flow restriction elements as orifices through a sidewall of the base pipe.

4. The method as recited in claim 1, wherein forming comprises forming the plurality of flow restriction elements as tubes position between the base pipe and the screen, the tubes being coupled with holes through a sidewall of the base pipe.

5. The method as recited in claim 1, wherein forming comprises forming the plurality of flow restriction elements as openings through a side wall of the base pipe, the openings being one to five times the size of slot openings through the screen.

6. The method as recited in claim 1, wherein spacing comprises spacing the plurality of flow restriction elements evenly along the base pipe to provide a controlled, constant pressure drop along the entire base pipe located radially beneath the screen.

7. The method as recited in claim 2, further comprising forming the nozzles as nozzle inserts with each nozzle insert having an opening with an increasing diameter along the direction of fluid flow.

8. The method as recited in claim 1, further comprising forming the screen with a drainage layer positioned adjacent to the base pipe.

9. The method as recited in claim 1, wherein spacing comprises locating the plurality of flow restriction elements to provide a varying pressure drop along the base pipe.

10. A method of preventing component erosion in a wellbore, comprising:

forming a sand screen assembly with a base pipe mounted within a sand screen;

providing a pattern of flow restriction elements along the base pipe to provide a controlled pressure drop across the base pipe; to evenly distribute a high rate flow of fluid along the sand screen; and to maintain the rate of flow of the fluid below a sand screen erosion rate; and;

deploying the sand screen assembly downhole into a well.

11. The method as recited in claim 10, wherein providing comprises providing a pattern of nozzles positioned in a side wall of the base pipe.

12. The method as recited in claim 10, wherein providing comprises providing a pattern of orifices through a side wall of the base pipe.

13. The method as recited in claim 10, wherein providing comprises coupling tubes to holes in a sidewall of the base pipe and orienting the tubes between the base pipe and the sand screen.

14. The method as recited in claim 11, further comprising forming each nozzle from a hardened insert.

15. The method as recited in claim 10, further comprising producing a gas through the sand screen assembly.

16. The method as recited in claim 10, further comprising flowing a condensate through the sand screen assembly.

17. The method as recited in claim 10, further comprising producing an oil through the sand screen assembly.

18. The method as recited in claim 10, further comprising injecting a fluid through the sand screen assembly.

19. The method as recited in claim 18, wherein injecting comprises injecting water through the sand screen assembly.

20. The method as recited in claim 18, wherein injecting comprises injecting a gas through the sand screen assembly.

21. A system for use in a wellbore, comprising:

a base pipe having a plurality of flow restriction elements extending from an exterior to an interior of the base pipe; and a sand screen positioned around the base pipe to filter particulates from an inflowing gas stream, wherein the plurality of flow restriction elements is located in a desired pattern along the base pipe, the desired pattern providing an even distribution of inflowing gas across the sand screen; establishing a controlled pressure drop across the base pipe; and also limiting the flow rate of inflowing gas to a rate less than a sand screen erosion rate.

22. The system as recited in claim 21, wherein the plurality of flow restriction elements comprises a plurality of nozzles.

23. The system as recited in claim 21, wherein the plurality of flow restriction elements comprises a plurality of orifices.

24. The system as recited in claim 21, wherein the plurality of flow restriction elements comprises a plurality of tubes coupled to a plurality of holes through a sidewall of the base pipe.

25. The system as recited in claim 23, wherein the flow of gas through a plurality of screen openings of the sand screen provides a small pressure drop in the same order of magnitude as the pressure drop along an exterior of the base pipe between distant flow restriction elements.

* * * * *